United States Patent [19]

Prouvost et al.

[11] Patent Number: 4,862,962

[45] Date of Patent: Sep. 5, 1989

[54] MATRIX TREATMENT PROCESS FOR OIL EXTRACTION APPLICATIONS

[75] Inventors: Laurent Prouvost, Sorbiers, France; Michael I. Economides, Houston, Tex.

[73] Assignee: Dowell Schlumberger Incorporated, Tulsa, Okla.

[21] Appl. No.: 173,512

[22] Filed: Mar. 25, 1988

[30] Foreign Application Priority Data

Apr. 2, 1987 [FR] France ..... 87 04679

[51] Int. Cl.[4] ..... E21B 49/00

[52] U.S. Cl. ..... 166/250; 73/155

[58] Field of Search ..... 166/307, 250, 252; 73/151, 155

[56] References Cited

U.S. PATENT DOCUMENTS 3,636,762 1/1972 Kuo et al. ..... 73/155

4,328,705 5/1982 Gringarten ..... 73/155

4,423,625 1/1984 Bostic, III et al. ..... 73/155

4,597,290 7/1986 Bourdet et al. ..... 166/250 X 4,607,524 8/1986 Gringarten ..... 73/152

4,677,849 7/1987 Ayoub et al. ..... 73/155

*Primary Examiner*—Bruce M. Kisliuk

*Attorney, Agent, or Firm*—Stephen A. Littlefield

[57] ABSTRACT

The matrix treatment of a subterranean formation is adjusted in real time to minimize formation damage as indicated by the skin factor. The process comprises initial injecting an inert fluid into the formation and observing the variation in injection pressure over time. During the matrix treatment with a treatment fluid, the pressure is again observed over time and, by comparison with the pressure variation noted in the inert fluid injection phase, the skin factor is determined. The treatment parameters are then adjusted in real time to minimize the skin factor thereby minimizing formation damage.

3 Claims, 2 Drawing Sheets

MATRIX TREATMENT PROCESS FOR OIL EXTRACTION APPLICATIONS

Figure 1:
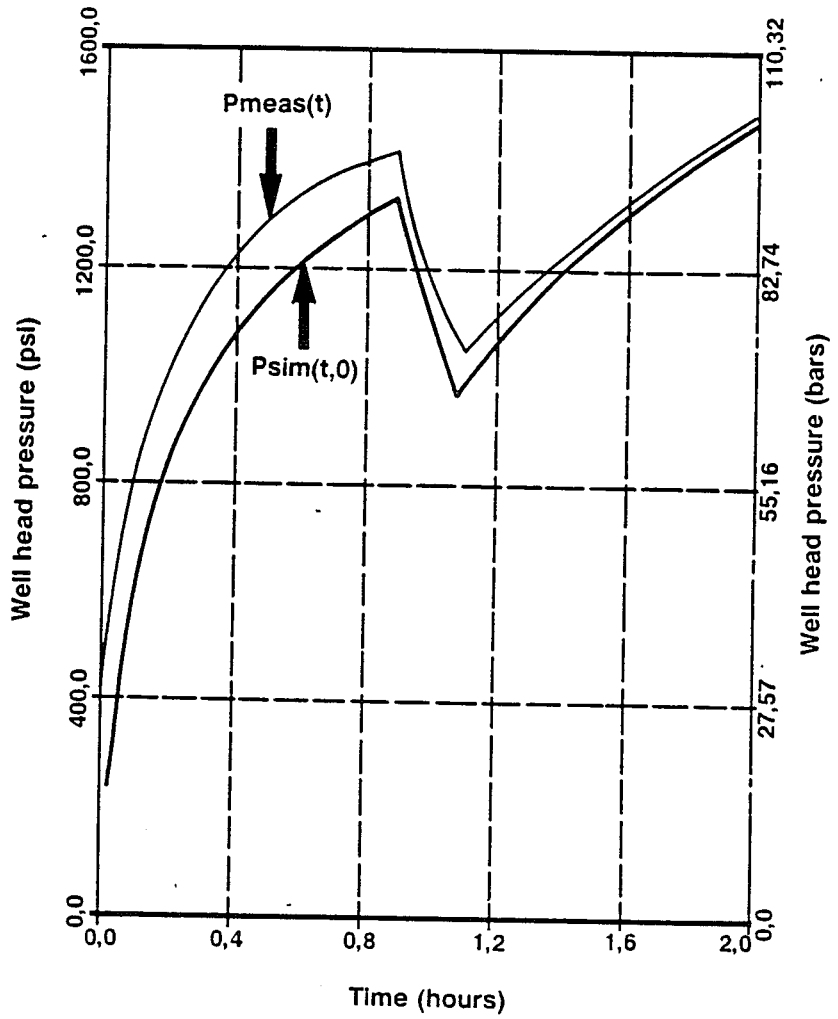

The sector concerned by this invention is that of oil and oil-related industry, more specifically treatment of matrices or reservoirs (subterranean formations containing various fluids used by the oil industry, whether natural or injected). This sector covers injection, production and geothermal wells, gas and water wells, etc.

One skilled in the art is perfectly aware of the various fluids used for purposes related to the above: acids, concentrated or variously diluted acid mixtures (especially HF, HCl, $H_3BO_3$, $HBF_4$, $H_3PO_4$ and various organic acids or acid precursors such as esters, ...) diluted in known proportions, temporary or permanent plugging fluids, gelled polymers, water, diesel oil, gas oil, solvents, etc.

It is entirely useless here to repeat their nature and the classical uses to which they are put.

In fact, the invention does not involve a new treatment fluid, but a new treatment process using known treatment fluids, the process being more efficient and precise, thus minimizing damage.

The invented process consists of two main stages:

A. Definition of the reservoir type and parameters. The reservoir type and parameters may have been defined by preceding classic analyses (highly expensive well testing). If this is the case, the invention uses these data. If such data are not available, one is often content or constrained (for various technical and economical reasons) to use mean values stemming from more or less rough approximations as initial parameters.

Conversely, the invention proposes to determine these parameters through a simple procedure immediately before the treatment itself. This procedure is described below and has the definite advantages of: (a) using the equipment already designed for the treatment, (b) hardly increasing the treatment cost at all, (c) leading directly into the treatment, and (d), enabling initial parameters to be obtained which, for the first time, are precisely known. This important improvement in precision has a significant effect on the treatment's precision and quality.

The procedure above consists of the injection of an inert preflush fluid, which is non-damaging and non-stimulating to the formation. This fluid can be a gas oil type, methylbenzene, dimethylbenzene or even KCl, $NH_4Cl$ or NaCl brine or filtered sea water with or without mutual solvents and other known additives. Of the brines, $NH_4Cl$ is to be preferred.

However, the invention is characterised in that it especially recommends direct use of the oil formation fluid which has pervaded the well or has been produced by the formation and collected and stored at the surface. By reinjecting this oil into the formation as preflush, a remarkably practical and economical test is realized, giving rise to considerably more exact results than those produced by preceding techniques, as they are based on fact.

Moreover, these results have the advantage of immediately preceding the treatment and the use of oil (natural formation fluid) has the advantage of not being likely to disturb measurement of the initial state of the reservoir, unlike other exogenous fluids which could disturb measurement.

These results give:

the reservoir type: homogeneous, fissured, faulted, stratified, ...

its basic parameters, notably the kh (hydraulic conductivity or permeability x thickness) which indicates the permeability and the initial skin.

It should be remembered that the skin factor indicates the degree of damage undergone by the formation in the immediate proximity of the well (most often from 0 to 1 m).

To obtain the above results, the preflush fluid (preferably oil, in accordance with the invention) is injected, a shut-in is carried out (pumping stoppage) and the resulting pressure drop is observed as a function of time. In some cases, where reservoir pressure is insufficient to the point of not enabling the pressure drop curve to be registered at the surface (and if there is no pressure gauge below) shut-in is replaced by violent variation in injection flow rate (rise or fall) and the resulting pressure variation is then examined as above.

These procedures are known by their general designation of "Injection/Fall-off Test" or injection/shut-in test and a pressure variation curve analysis enables the reservoir data to be obtained.

Other known analysis techniques could also be used, such as the Horner and analogous methods.

Study of the data obtained above facilitates participation in determining the details of the treatment procedure applied to the reservoir in question (type and sequence of fluids injected, volumes, pressures, possible injection of ball-sealers, use of diverters, etc.), commonly known as treatment "design".

B. Treatment:

The initial skin (and the other reservoir specificities and parameters) are known from stage A.

The invention is characterised in that the "design" is implemented by recording essential phase parameters (output, pumping duration, fluid rheology, pressure, etc.), for each design, phase.

The Psim curve is then drawn (this comprises a theoretical curve representing the well-head or bottom pressure variation as a function of time), from actual pumping sequence data. The "theoretical" nature of the curve stems from the fact that it represents the pressure variation that would occur if the physical state of the reservoir remained unchanged in its original state (notably, damage) as determined in stage A, i.e. ignoring injection fluid reactivity and rock reaction. However, treatment causes the reservoir to change.

The originality of this invention consists in comparing the Psim curve with the Pmeas curve (actual pressure variation as a function of time, measured in real time familiar data acquisition and recording devices, themselves linked to equally familiar surface or bottom sensors and gauges), then drawing the curve of skin factor variation as a function of time. The latter operation is made possible due to the new approach which is the basis of the invention. This approach consists in considering that the difference between the Psim (t) curve and the Pmeas (t) curve is solely due to the skin variation, a conclusion resulting from the precision with which the reservoir parameters and thus the Psim (t) curve are known using the invention.

This approach is completely original and permits reliable and precise operation for the first time.

Using the invented process, it is therefore possible to draw the skin=f (t) curve precisely, which enables: (1) skin evolution (and so reservoir reaction to current treatment) to be monitored in real time, and therefore treatment to be adjusted and optimised, even modified, for exact adherence to the design, and (2) a precise treatment stopping time to be determined: this time is reached when the skin value reaches a certain value, and depends on the reservoir characteristics (in homogeneous reservoirs, it is reached when the skin value reaches zero).

In FIG. 1 annexed, the curves of Psim and Pmeas as a function of time are shown.

Figure 2:
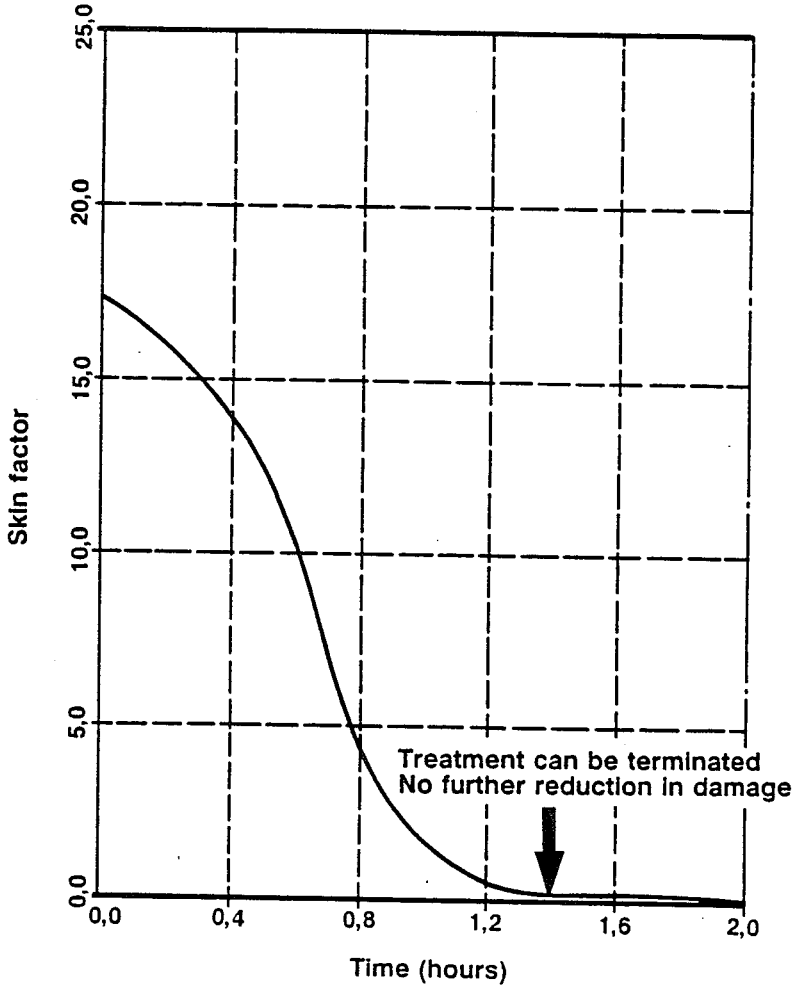

FIG. 2 annexed shows the corresponding skin evolution during treatment, deduced from FIG. 1 as explained above.

It should not be forgotten that the Pmeas (t) and skin (t) curves are drawn from measurements obtained in real time. Naturally, pumping rates are used which are suited to the native rock (not opening up natural faults and not causing hydraulic fractures). For the first time, therefore, the on site operator can control treatment evolution, check efficiency, adjust it to concur with the design despite the always somewhat unpredictable reservoir reactions, and finally, stop treatment exactly at the desired time while checking (FIG. 2) that damage has not occurred, which was the initial aim of the treatment.

In practive, the invented process, by using an original approach, thus affords considerable progress in respect of a problem which has been recognised as such since the beginnings of oil prospection.

We claim:

1. A process for matrix treatment of a subterranean formation comprising the steps of:

(a) conducting an injection/shut-off test of the formation by injecting an inert, non-damaging and non-stimulating fluid into the formation and determining initial well characteristics by observing and recording variations of test pressure over time;

(b) injecting treatment fluid into the formation while observing in real time variations of treatment pressure over time;

(c) determining a real time skin factor by calculating the divergence between the test pressure and the treatment pressure, and (d) adjusting treatment parameters to minimize the skin factor.

2. The process as set forth in claim 1 wherein the inert fluid is selected from a group consisting of gas oil, toluene, xylene, KCl brine, $NH_4Cl$ brine, NaCl brine, filtered sea water, natural solvents and mixtures thereof.

3. The process as set forth in claim 1 wherein the inert fluid is hydrocarbon fluid produced from the formation.

* * * * *